United States Patent [19]

Price

[11] 4,290,438

[45] Sep. 22, 1981

[54] STATIC ELECTRICITY GROUNDING COMB

[76] Inventor: Garey W. Price, 4817 Corwin La., Riverside, Calif. 92503

[21] Appl. No.: 131,475

[22] Filed: Mar. 18, 1980

[51] Int. Cl.[3] ..... A45D 24/00

[52] U.S. Cl. ..... 132/11 R

[58] Field of Search ..... 132/11 R; 174/6; 361/220, 221; 339/150

[56] References Cited

U.S. PATENT DOCUMENTS

| | | | |
|---|---|---|---|
| 2,479,253 | 8/1949 | Prediyer | 132/11 R UX |
| 3,084,700 | 4/1963 | Fischer et al. | 361/221 |
| 4,154,430 | 5/1979 | Pfarr, Jr. | 174/6 |

*Primary Examiner*—G. E. McNeill

*Attorney, Agent, or Firm*—Jack C. Munro

[57] ABSTRACT

A comb for removing static electricity which is normally produced in the combing of hair. The comb body is constructed (by being electrically conductive) to remove the static electricity during the combing operation. The handle portion of the comb body is attached to an electrical conductor, such as wire. This electrical conducting wire terminates in a conventional electrical plug which has male electrical grounding connectors which function as securing connectors. The securing connectors and the grounding connector are to cooperate in a conventional manner with a conventional electrical wall socket. The male securing connectors are non-electrically conductive. The static electricity is grounded through the electrical grounding connector.

2 Claims, 2 Drawing Figures

STATIC ELECTRICITY GROUNDING COMB

BACKGROUND OF THE INVENTION

The field of this invention relates generally to a hair grooming device and more particularly to an electrical grounding hair grooming device which removes static electricity from the hair.

The setting of one's hair into a particular style is desirable by most individuals, male and female. The presence of static electricity has been known to be one of the principal causes of the hair being unmanageable, that is, making it difficult to set the hair in a particular style.

It has been found that frequently the presence of static electricity is produced during the grooming of the hair, such as by combing or brushing. Therefore, inherently, styling of the hair has the tendency to produce the effect of static electricity.

Previously, in recognition of the problem of static electricity, various anti-static shampoos and chemical compounds have been introduced to the market in recent years with advertising claims that they impart many desirable features to the hair through dissipation of static electricity. These compounds are expensive and do not overcome the static effects as completely as is desirable. Furthermore, these compounds by prolonged use, could have certain undesirable effects on some scalps. A need exists for a reasonably inexpensive device which completely eliminates the effect of static electricity without subjecting the hair and scalp to deleterious materials.

SUMMARY OF THE INVENTION

The structure of this invention includes a comb body which is constructed to be electrically conductive. The comb body will normally be a plastic compound uniformly imbedded with carbon. The comb body includes a handle section. An electrically conductive wire is imbedded within the outer end of the handle section. This electrically conductive wire then connects at its outer end to a conventional electrical male plug. The male plug includes an electrical grounding connector and a pair of male electrical connectors which are used, in this instance, as securing means for the plug. The plug is to be inserted in a normal manner with the electrical wall socket assembly. However, in this instance, the securing connectors are non-electrically conductive where normally they would be the source of electrical energy for whatever device the plug would be connected. The static electricity from the hair is conducted through the comb body and through the electrical conductor to the electrical grounding connector and is dissipated through the electrical ground of the wall socket assembly. In other words, the device of this invention does the opposite from the normal in that electrical energy is conducted from the comb to the electrical wall socket, rather than vice versa.

It is therefore the major object of this invention to provide a device which is highly effective in removing undesirable static effects from hair and is to accomplish such as the hair is being groomed.

It is another object of this invention to provide an electrically conductive hair grooming device which is readily connectable to conventional electrical wall socket assemblies in the normal manner.

Another object of this invention is to construct a device which can be constructed at a low cost and therefore sold at a most reasonable price.

DETAILED DESCRIPTION OF THE SHOWN EMBODIMENT

Figure 1:
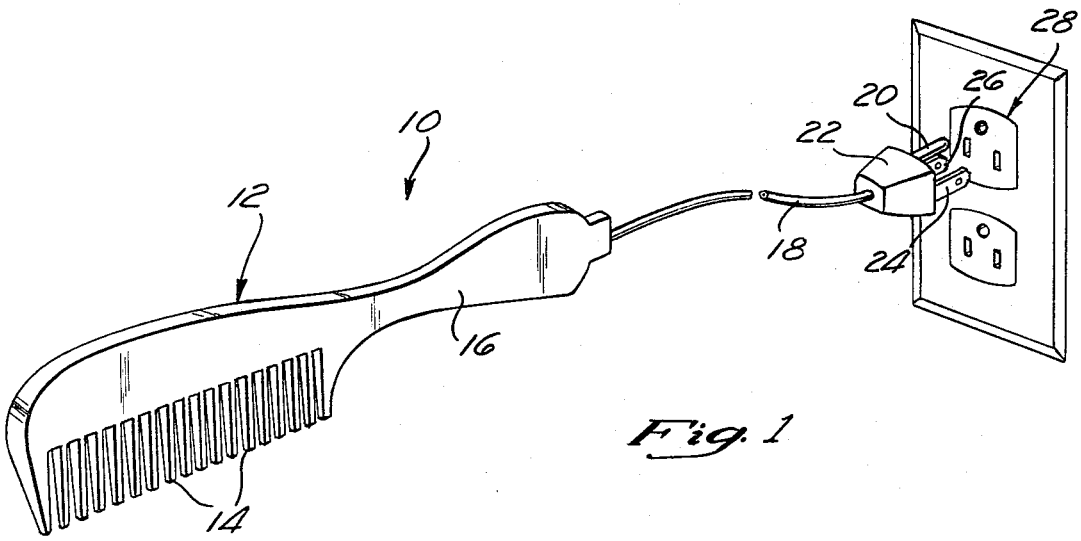
FIG. 1 is an isometric view of the hair grooming device of this invention.
Figure 2:
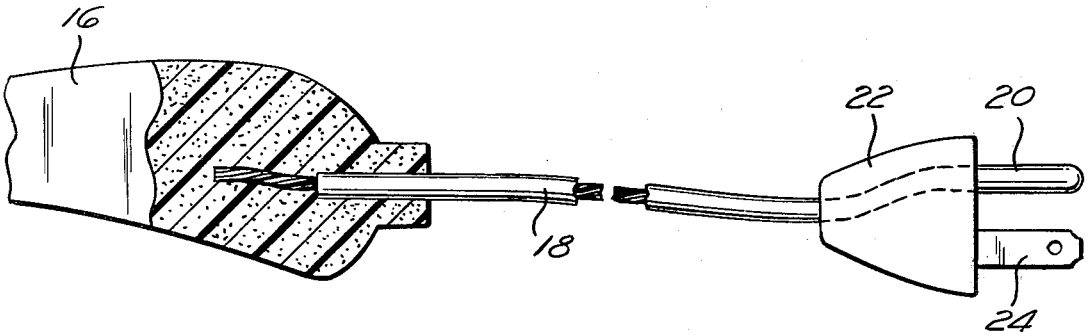
FIG. 2 is a segmental, partly-in-cross-sectional view of a portion of the hair grooming device of this invention.

Referring particularly to the drawing, there is shown the static electricity grounding comb 10 of this invention which provides for a comb body 12 which includes a plurality of combing teeth 14. The comb body 12 includes a graspable handle section 16. The entire comb body 12 is to be constructed to be electrically conductive. An easy way for this to occur is for the comb body 12 to have carbon uniformly distributed throughout. The primary material in the comb body 12 is plastic.

Imbedded into the outer end of the handle section 16 is the bared end of an electrical conductor 18. This electrical conductor 18 is deemed to be conventional and is what is frequently termed an electrical wire. Any desirable length of the electrical conductor 18 could be chosen.

The outer end of the electrical conducting wire 18 is connected to an electrical grounding connector 20 of a conventional electrical plug 22. The electrical plug 22 also includes a pair of connectors 24 and 26. These connectors 24 and 26 would under normal circumstances supply electrical energy from a conventional wall socket 28 through an apparatus to be driven by electricity. However, in this particular instance, the connectors 24 and 26 are non-electrically conductive and are only for the purpose of securing in place the plug 22 to the wall socket 28. The electrical ground connector 20 mates with the electrical grounding portion of the conventional wall socket 28.

Therefore, during operation of the comb body 12 during grooming, static electricity is conducted from the hair through the comb body and into the electrical conductor 18 and is dissipated through the electrical grounding connector 20 through the wall socket 28.

What is claimed is:

1. An electrically grounding comb for hair comprising:

a comb body, said comb body being electrically conductive, said comb body including a handle section; and an electrical conductor having an inner end and an outer end, said inner end being embedded within said handle section and adapted to conduct static electricity from said comb body, said outer end comprising a plug, said plug having a grounding connector and a pair of securing connectors, said electrical conductor being electrically connected with said electrical grounding connector, said securing connectors being non-electrically conductive, whereby said securing connectors are to connect with mating openings within a conventional wall socket and simultaneously said grounding connector connects with a mating electrical grounding opening and static electricity is conducted from hair being combed through the comb and through said electrical conductor and is discharged through said electrical grounding connector.

2. The comb as defined in claim 1 wherein:

said comb body comprising a plastic uniformly imbedded with carbon.

* * * * *